US006741831B2

(12) United States Patent
Seto

(10) Patent No.: US 6,741,831 B2
(45) Date of Patent: May 25, 2004

(54) IMAGE FORMING DEVICE AND FEED DEVICE

(75) Inventor: Takashi Seto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/334,829

(22) Filed: Jan. 2, 2003

(65) Prior Publication Data

US 2003/0129008 A1 Jul. 10, 2003

(30) Foreign Application Priority Data

Jan. 7, 2002 (JP) ..... 2002-000878
Nov. 11, 2002 (JP) ..... 2002-326379

(51) Int. Cl.[7] ..... G03G 15/00
(52) U.S. Cl. ..... 399/388
(58) Field of Search ..... 399/16, 38, 394, 399/395, 388; 347/129

(56) References Cited

U.S. PATENT DOCUMENTS 4,592,651 A 6/1986 Oikawa et al.
4,640,611 A 2/1987 Ohdake et al.
4,919,531 A 4/1990 Mashiko et al.
4,942,422 A 7/1990 Mashiko et al.
5,060,012 A 10/1991 Seto et al.
5,134,429 A 7/1992 Ishikawa et al.
5,263,698 A 11/1993 Higuchi et al.
5,521,679 A 5/1996 Miyakawa et al.
6,345,170 B1 2/2002 Nakazato et al.
6,470,169 B2 * 10/2002 Nakazato ..... 399/388

FOREIGN PATENT DOCUMENTS

JP 2001-130812 5/2001

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

An image forming device for avoiding a concentrated contact of transfer means, including rollers, with sheet edges in a prescribed position and preventing an earlier replacement of fixing rollers in an image forming section, etc., caused by their surface exfoliation, is provided. The device has a movable member for regulating the positioning of the sheet edges parallel to the transfer direction of a sheet on a transfer passage. A regulating position for positioning the sheet by the movable member, i.e., the position of the sheet transferred to the image forming section, is randomly changed and a write-in position in the image forming section is changed conforming to the position of the sheet to make the regulating position of the movable member changeable. Thus, the concentrated contact of the transfer means with the sheet edges is avoided and the earlier replacement of the fixing rollers, etc., is prevented.

21 Claims, 8 Drawing Sheets

IMAGE FORMING DEVICE AND FEED DEVICE

CROSS-REFERENCE TO RELATED APPLICATION

This application claims the priority benefit of Japanese application serial no.2002-000878, filed on Jan. 7, 2002; 2002-326379, filed on Nov. 11, 2002.

BACKGROUND OF THE INVENTION

1. Field of the Invention

This invention relates in general to an image forming device for forming images on a sheet, and a feed device.

2. Description of Related Art

In the application of image forming devices, such as a printer or a copier, improving the productivity of sequential image forming operations has been in demand. One method to meet the demand is to reduce the distance between respective sheets, which are transferred through an image forming section.

However, merely reducing the distance between sheets as they are separately fed from a sheet housing section, such as a sheet tray, is prone to pose a problem that a preceding sheet and a following sheet overlap each other in the image forming section. The problem occurs when a sheet slips upon its separate feeding, a sheet transfer speed changes as time passes or operational environment changes, or a stop time for registering is uneven.

To avoid such a problem, it has been practiced that at least the distance of several ten mm is provided between preceding and following sheets when images are formed sequentially on the sheets. As a result, however, a time span in which actually no image is formed becomes longer in the sequential image forming, deteriorating the productivity of image forming operation.

An image forming section employing an electrophotograhic method is constituted so as to operate without stopping even when the image forming section actually forming no image once it starts forming images. Therefore, a long distance between sequentially fed sheets results in a longer idling of the image forming section, reducing the life of the image forming section to produce less printed materials than the amount expected to be produced in the original lifetime.

It will be appreciated that the electrophotographic image forming section having a digital write-in means includes a polygon mirror constituting part of the write-in means, wherein the rotating speed of the polygon mirror is limited. It may be tried to increase the transfer speed of sheets in the image forming section, and addition to that, it is essential to correspondingly increase the rotating speed of the polygon mirror in order to improve the productivity of image forming operation. However, since the polygon mirror has a limit of its rotating speed, the above effort is limited.

Under these circumstances, the applicant of the present application disclosed in the Japanese Laid Open Publication No. He2001-130812 an image forming device, which can improve the productivity of image forming operation in the case of sequential image forming. In the image forming device, an inverting passage and a sheet inverting means are provided in the middle of a sheet transfer passage to make a sheet switch back, reducing the distance between the sheets sent to an image forming section.

According to the above image forming device having the inverting passage and the sheet inverting means, a sheet is transferred through the sheet transfer passage to be sent to the inverting passage, where the sheet is temporarily stopped and made to switch back, and is sent to the image forming section. Upon switching back, the speed of sending the sheet to the inverting passage, the speed of sending the sheet out of the inverting passage, and the timing of sending the sheet out of the inverting passage are controlled. As a result, the distance between the sheets, which are sent to the image forming section after having switched back, can be reduced, which improves the productivity of image forming operation.

In the operation of the image forming device described above, however, as a sheet is sent to the inverting passage at a high speed, the sheet may come to skew. Such a skewed sheet sent out of the inverting passage skews in the image forming section, rendering the corner of the sheet folded, thus causing a problem of what is called folded edge.

To handle such a problem, efforts have been made to correct the skew of a sheet just before it is sent out from the inverting passage. That is, it has been carried out a sidewise registration operation to set the sheet in a proper arrangement in the direction (horizontal direction) perpendicular to the sheet transfer direction so as to correct the skew of the sheet sent to the inverting passage.

According to conventional sidewise registration operations for sheet position adjustment, a pair of side fences or joggers are operated in a symmetrical manner so as to keep the center of a sheet in a constant position (what is called a center reference), or a sheet is set along a side guide so as to keep the edge of the sheet passing through the same position (what is called an edge reference). Therefore, when sheets having the same width are transferred, the passing position of the sheet edges are constantly the same, which makes it a common case without almost no exception that the sheet edges are adjusted by a sheet width commonly employed (for example, for adjusting the width of A4 size, or the length of A3 size within—mm) and are passed between rollers.

When the sheet edges keep passing through the same position, however, the contact frequency between the sheet edges and the rubber rollers in a position other than the above same position becomes low, resulting in concentration of the contact between the edges and the rollers on the same position, damaging the part of the rollers corresponding to the position. This causes such an inconvenience as a surface exfoliation of a fixing roller, which leads to an earlier replacement of the roller. It will be also recognized that a temperature increase of the ends of the fixing rollers in the image forming section becomes another problem when the passing position of the sheet edges is constantly the same.

Besides, in conventional image forming devices, when a sheet on which images are formed is "sorted" for every print job, it is common that an image-fixed sheet is sorted over by shifting the position of the sheet in the direction perpendicular to the transfer direction (doggy tail).

In such a case, however, a dedicated large finisher and the like is required, which makes impossible for a single image forming device to execute a sorting operation.

SUMMARY OF THE INVENTION

According to the foregoing description, it is an object of this invention to provide a image forming device and a feed device, with which concentrated contact of sheet edges with transfer means, such as rollers, in a prescribed position can be avoided, and earlier replacement of the rollers, such as fixing rollers in a image forming section, due to their surface exfoliation, can be prevented.

It is another object of this invention to provide an image forming device and a feed device, with which an operation of "sorting" sheets according to the number of printing can be executed with a simple constitution.

According to an aspect of the present invention, in the image forming device of the present invention, sheets piled up and held in a sheet housing section are separately fed one after another by a separate feed means and an image is formed on the sheet transferred by a transfer means in an image forming section, comprises a movable member provided on the sheet transfer passage leading from said separate feed means to said image forming section and regulating the positioning of the edges of the sheet parallel to the transfer direction, the sheet being transferred through said sheet transfer passage; a regulating position change means for randomly changing a regulating position for positioning the sheet by said movable means; and a write-in position change means for changing a write-in start position in said image forming device in conformity to the position of the sheet transferred to said image forming section.

Accordingly, the regulating position for positioning the sheet by the movable member is randomly changed, and the write-in start position in the image forming section is also changed conforming to the changed regulating position for positioning the sheet, i.e., the position of the sheet which is to be transferred to the image forming section. As described above, the regulating position for positioning the sheet by the movable member is made changeable, so that concentration of the contact of sheet edges with transfer means, such as rollers, in a prescribed position is avoided and earlier replacement of rollers, such as fixing rollers in the image forming section, due to their surface exfoliation, can be prevented. Furthermore, a temperature increase of the ends of the fixing rollers in the image forming section can also be suppressed.

According to an aspect of the present invention, in the image forming device of the present invention, the regulation of positioning a sheet by said movable member is executed while the sheet on said sheet transfer passage is free from pressure application by any members.

Since positioning the sheet by the movable member is regulated while the sheet is free from any pressure application, the sheet comes to be temporarily free from any regulation of its position, which makes it possible to adjust smoothly the position of the sheet in the direction perpendicular to the proceeding direction.

According to an aspect of the present invention, in the image forming device of claim of the invention, the movable member has a pair of regulating members, which are arranged in parallel in the positions opposite to respective edges of a sheet parallel to the transfer direction, and said regulating position change means moves said each regulating member asymmetrically.

By moving asymmetrically the pair of regulating members arranged in parallel in the positions opposite to respective edges of the sheet parallel to the transfer direction, the position of the center line of each sheet can be shifted even if the size of the sheets are the same, so that the position regulation in the direction perpendicular to the proceeding direction can be easily made.

According to an aspect of the present of the invention, in the image forming device of the present invention, each regulating member is arranged in such a way that each can reciprocate independently in the direction of its contacting with or departing from the edge of a sheet parallel to the transfer direction.

Therefore, it becomes possible that the pair of regulating members each arranged in parallel in the positions opposite to respective sides of the sheet can be moved asymmetrically.

According to an aspect of the present invention, in the image forming device of the present invention, each regulating member is moved to the position where the distance between each regulating member becomes narrower than the width of a sheet.

Therefore, even if the widths of sheets are uneven (even if it is changed by an environmental factor), the position the sheet in its width direction can be adjusted without fail.

According to an aspect of the present invention, in the image forming device of the present invention, the movable member has one regulating member, which is arranged in the position opposite and parallel to the edges of a sheet parallel to the transfer direction, and a skewing roller arranged in a state that its axis is inclined against the direction of sheet width, wherein said regulation position change means moves said regulating member in the direction of its contacting with or departing from the sheet edges parallel to the transfer direction.

As the one regulating member, which is arranged in the position opposite and parallel to the edges of a sheet parallel to the transfer direction, is moved in the direction in which the member contacts with or departs from the sheet edges parallel to the transfer direction, the skewing roller shifts the sheet to the regulating member. This makes possible to shift the position of the center line of each sheet even if the size of the sheets are the same, so that the position regulation in the direction perpendicular to the proceeding direction can be easily made.

According to an aspect of the present invention, in the image forming device of the present invention, the skewing roller has a cutout formed into a flat surface on part of the outer periphery of the roller. Only when a part other than the cutout part is abutted on a sheet, the sheet sent to the transfer passage is transferred toward the regulation member.

Therefore, when the sheet is sent to the movable member, the cutout of the skewing roller is made to face the sheet and the skewing roller is rotated at the moment when the rear end of the sheet has passed through the transfer means. In this manner, the position of the sheet in the direction of its width can be easily adjusted. It will be appreciated that the constitution described above is simpler than the one for making or releasing contact with the sheet by swinging move of an arm and the like, free from impact noises produced upon catching the sheet, thus, advantageous for suppressing operational noise.

According to an aspect of the present invention, in the image forming device of the present invention, the regulation of positioning a sheet by said regulating means is sustained until the sheet is sent out of said sheet transfer passage.

When the sheet becomes free from the regulation by the regulating member, the sheet has already received pressure from the transfer means of the sheet transfer passage, so that the position change of the sheet in the following course of transfer can be prevented.

According to an aspect of the present invention, in the image forming device of the present invention, the regulating position change means changes the regulating position for positioning a sheet by said movable member so that the regulating position is shifted to the left and right in a prescribed distance per a prescribed number of printing.

Accordingly, it becomes possible to "sort" the sheets by shifting the regulating position for positioning a sheet by said movable member to the left and right in a prescribed distance according to the number of printing, whereas "sort" operation has been carried out conventionally by shaking the whole body of an ejecting unit via a large finisher. Thus, an image forming device can be miniaturized and a sort operation can be carried out with a simple constitution.

According to an aspect of the present invention, in the image forming device of the present invention, the regulating position change means changes sequentially or randomly the regulating position for positioning a sheet by said movable member by a prescribed width.

By changing the regulating position in such a manner, concentration of the contact of sheet edges with the transfer means, such as rollers, in a prescribed position is avoided and earlier replacement of the rollers, such as the fixing rollers in the image forming section, due to their surface exfoliation, can be prevented without fail.

According to an aspect of the present invention, the image forming device of claim 10 comprises a re-feed passage connected between the sheet ejecting side of said image forming section and said sheet passage; and a path shift member, which is arranged in a position where it interferes with only one regulating position for positioning a sheet by said movable member, the position of arrangement being on the sheet eject side of said image forming section, and which shifts the transfer direction of the sheet, on which an image is formed in said image forming section after the regulating position of said movable member has been changed, to said re-feed passage.

Accordingly, when the regulation position is changed by the movable member so that only the sheet which is to be transferred to the re-feed passage interferes with the path shift member, the transfer direction of the sheet with an image formed thereon by the image forming section can be easily shifted to the re-feed passage without shifting the position of the path sift member at a high speed, even in the case of interleaf feeding where the passage shift is made during a time span corresponding to a short distance between the sheets (frequent passage shift).

According to an aspect of the present invention, the image forming device of the present invention further comprises an inverting passage, which is connected to the sheet transfer passage leading from said separate feed means to said image forming section and to which a sheet transferred through the sheet transfer passage is temporarily sent; and a sheet inverting means, which can be shifted to a send-out state for making the sheet sent to said inverting passage switch back and sending it out to said transfer passage and shifted to an open state for allowing at least part of a proceeding sheet being sent out of said inverting passage and of a following sheet being sent to said inverting passage to overlap; wherein said movable member is provided on said inverting passage.

In the image forming device, a sheet is separately fed one after another by the separate feed means in the sheet housing section, transferred through the sheet transfer passage, and is sent to the inverting passage, where the sheet is temporarily stopped. Then, the sheet inverting means makes the sheet switch back, sending it out of the inverting passage to the image forming section, where an image is formed on the sheet.

Upon making the sheet switch back, the speed of sending the sheet to the inverting passage, the speed of sending the sheet out of the inverting passage, and the timing of sending the sheet out of the inverting passage are controlled, so that the distance between the sheets, which are sent to the image forming section after made to switch back, can be reduced. As a result, it becomes possible to keep the distance between the sheets small in a precise manner upon sending it to the image forming section, even if the feed timing of the sheet housing section comes to fluctuate or a transfer speed during the transfer to the inverting passage becomes uneven. Thus, the productivity of image forming operation in the image forming device can be improved.

Also, providing the movable member on the inverting passage makes it possible for the movable member to constantly carry out the regulation of positioning the sheet in a stable position.

According to an aspect of the present invention, in the image forming device, the sheet inverting means has a pair of rollers, one of which has a cutout formed on part of its outer periphery, wherein the direction of the cutout enables the shift between said send-out state for making the rollers nip a sheet and said open state for allowing the sheet to pass between both rollers.

The constitution described above is simpler than the one makes or releases contact with the sheet by swinging move of an arm and the like, free from impact noises produced upon catching the sheet, thus, operational noise can be suppressed.

According to an aspect of the present invention, in the image forming device, the outer periphery length, excepting the part of cutout, of one roller is made longer than the distance from the front end of a sheet in a state of just being released from contact with said rollers to the next said transfer means on said sheet transfer passage.

This arrangement enables the sure transfer of the sheet to the next transfer means.

According to an aspect of the present invention, in the image forming device, the sheet transfer passage leading from said separate feed means to said image forming section has an almost horizontal plane, via which a sheet is transferred in the direction almost horizontal to the surface of sheets stacked up and held in the sheet housing section and which is provided with said movable member.

The sheet separately fed one after another by the separate feed means is transferred to the almost horizontal plane, where the position of the sheet is adjusted randomly and the sheet is transferred in the direction almost horizontal to the surface of sheets stacked up and held in the sheet housing section, and is sent to the image forming section. In this manner, the sheet position can be adjusted randomly without inverting the transfer direction of the sheet (straight transfer).

According to an aspect of the present invention, in the image forming device, the sheet transfer passage leading from said separate feed means to said image forming section has an almost vertical plane, via which a sheet is transferred in the direction almost vertical to the surface of sheets stacked up and held in the sheet housing section and which is provided with said movable member. An elastic member is provided on said sheet transfer passage on the downstream side to said movable member in the transfer direction in order to hold the sheet by applying a low load to prevent it from falling off or moving because of its weight.

The sheet separately fed one after another by the separate feed means is transferred to the almost vertical plane, where the position of the sheet is adjusted randomly and the sheet is transferred in the direction almost vertical to the surface of sheets stacked up and held in the sheet housing section, then is sent to the image forming section. It will be appreciated that the elastic member can prevent the sheet from moving because of its won weight even when the sheet is released from pressure application by the transfer means during transfer. Therefore, the sheet position can be adjusted randomly without inverting the transfer direction of the sheet (straight transfer).

According to an aspect of the present invention, in the image forming device, the image forming section is an image forming section employing an electrophotographic method.

The image forming device forming images by the electrophotographic method can provide an operational effect equivalent to that described above.

According to an aspect of the present invention, in the image forming device, the image forming section is an electrophotograhic image forming section having a digital write-in means.

The image forming device forming images by the digital electrophotographic method can provide an operational effect equivalent to that described above.

According to an aspect of the present invention, a feed device separately feeds a sheet one after another by a separate feed means, said sheets stacked up and held in a sheet housing section, for an image forming device provided with an image forming section for forming an image on the sheet. The feed device comprises a movable member provided on a sheet transfer passage leading from said separate feed means to said image forming section and regulating the positioning of the edges of the sheet parallel to the transfer direction, the sheet being transferred through said sheet transfer passage; and a regulating position change means for randomly changing the regulating position for positioning the sheet by said movable means.

In the above image forming device, therefore, the regulating position for positioning the sheet by the movable member can be changed randomly. By making the regulation position for the sheet changeable, as mentioned above, concentration of the contact of sheet edges with transfer means, such as rollers, in a prescribed position is avoided and earlier replacement of rollers, such as fixing rollers in the image forming section, due to their surface exfoliation, can be prevented.

According to the image forming device of present invention, sheets piled up and held in a sheet housing section is separately fed one after another by a separate feed means and an image is formed on the sheet transferred by a transfer means in an image forming section, the image forming device comprises a movable member provided on the sheet transfer passage leading from said separate feed means to said image forming section and regulating the positioning of the sides of the sheet parallel to the transfer direction, the sheet being transferred through said sheet transfer passage; a regulating position change means for randomly changing a regulating position for positioning the sheet by said movable means; and a write-in position change means for changing a write-in start position in said image forming device in conformity to the position of the sheet transferred to said image forming section.

Accordingly, the regulating position for positioning the sheet by the movable member is randomly changed in the direction of sheet width, and the write-in start position in the image forming section is also changed conforming to the changed regulating position for positioning the sheet, i.e., the position of the sheet which is to be transferred to the image forming section. As described above, the regulating position for positioning the sheet by the movable member is made changeable in the sheet width direction, so that concentration of the contact of sheet edges with transfer means, such as rollers, in a prescribed position is avoided and earlier replacement of rollers, such as fixing rollers in the image forming section, due to their surface exfoliation, can be prevented. Furthermore, a temperature increase of the ends of the fixing rollers in the image forming section can also be suppressed.

In the image forming device of the present invention, the movable member has a pair of regulating members each arranged in the position opposite to respective sides of a sheet, wherein said regulating position change means moves said each regulating member asymmetrically.

By moving asymmetrically the pair of regulating members arranged in parallel in the positions opposite to respective sides of the sheet, the position of the center line of each sheet can be shifted even if the size of the sheets are the same, so that the position regulation in the direction perpendicular to the proceeding direction can be easily made.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

The first embodiment of the present invention is described referring to FIG. 1 to FIG. 7 as follows.

Figure 1:
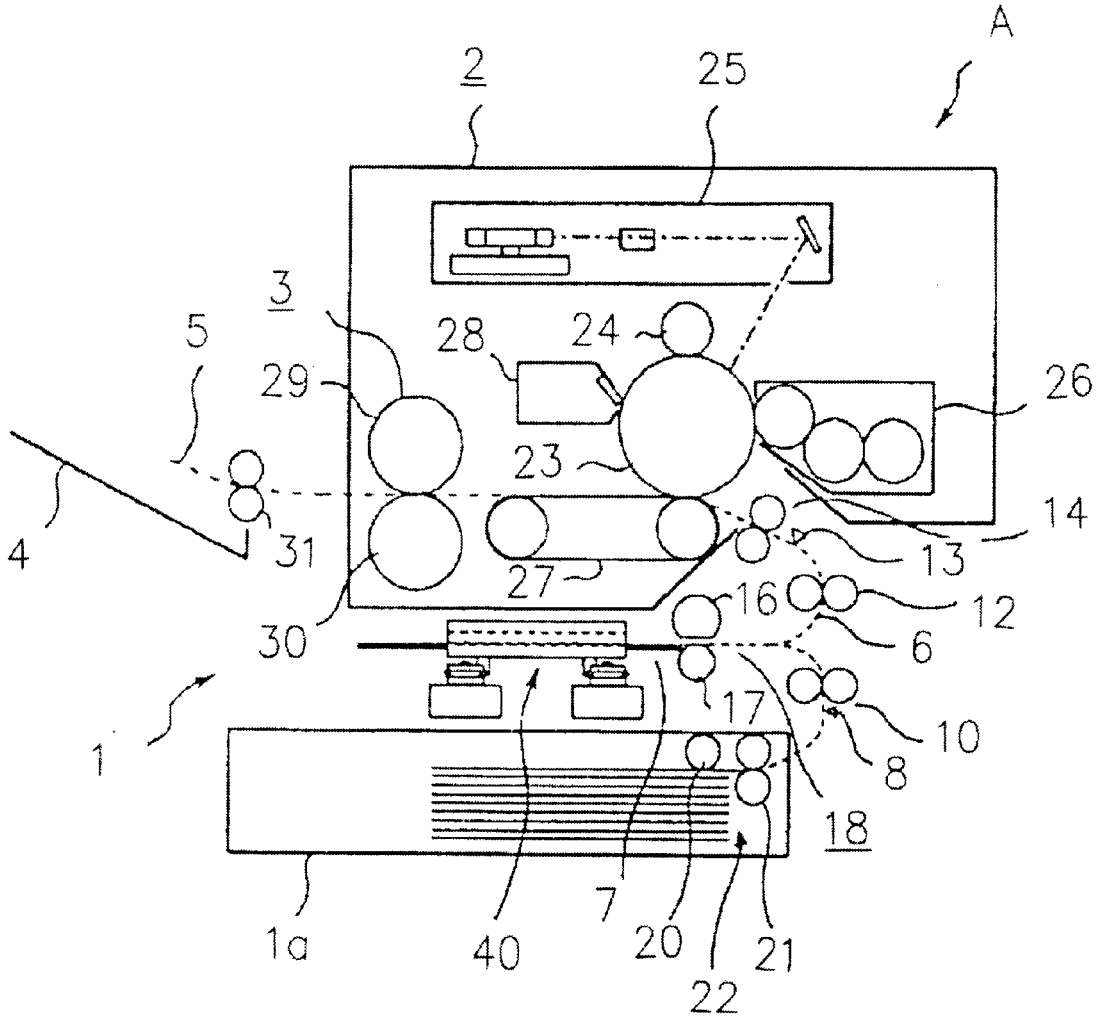
FIG. 1 is a schematic diagram showing the overall constitution of an image forming device having an electrophotographic image forming section according to the first embodiment of the present invention.
Figure 2:
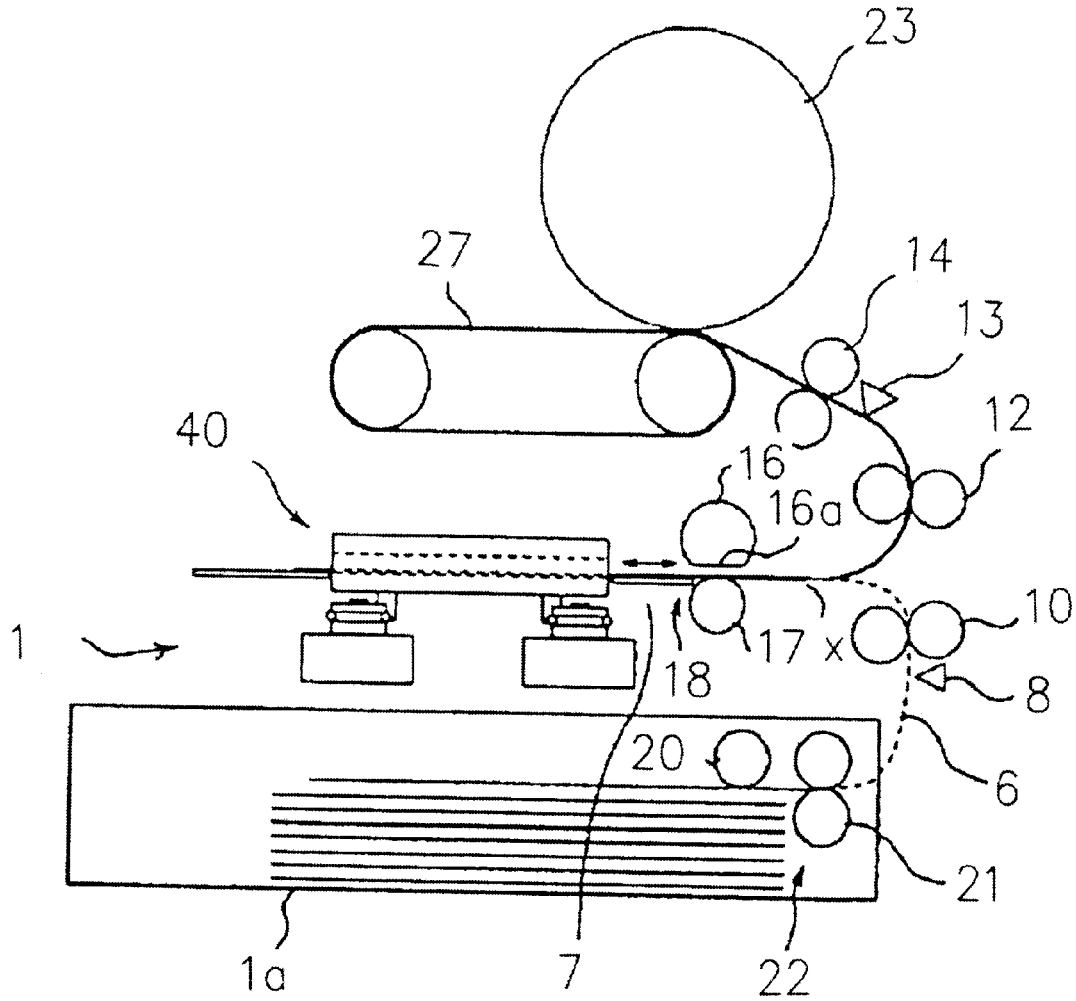
FIG. 2 is a schematic diagram showing an enlarged view of an inverting passage for making a sheet on transfer switch back.

FIG. 1 is the schematic diagram showing the overall constitution of the image forming device having the electrophotographic image forming section, and FIG. 2 is the schematic diagram showing an enlarged view of the inverting passage for making a sheet on transfer switch back.

As illustrated in FIG. 1, the image forming device A comprises a feed device 1 provided with a sheet feeding tray 1*a*, i.e., a sheet housing section for stacking up and holding sheets; a printer engine 2, i.e., the image forming section for forming an image on a sheet by an electrophotographic method; and a sheet transfer path 5 starting from the feed device, passing through a fixing unit 3 for fixing the formed image on the sheet to reach an ejecting stacker 4 for ejecting the sheet with the formed image. A sheet transfer passage 6 constitutes the part of the sheet transfer path 5 covering from the feed tray 1*a* to the printer engine 2.

On the downstream side to the feed tray in the direction of sheet transfer, a separate feed means 22 for feeding sheets to the sheet transfer passage 6, the separate feed means consisting of a pickup roller 20 for picking up the sheets from the stack of sheets and a separating rollers 21 for separating one sheet out from the picked up sheets.

On the transfer passage 6, the following components are arranged: a sheet end detecting sensor 8 for detecting the end of the sheet, a first transfer rollers 10 driven by a motor 9 (See FIG. 5) for transferring the sheet, a second transfer rollers 12 driven by a motor 1 (See FIG. 5) so as to send the switched back sheet to the printer engine 2, as described later, a register sensor 13, and a register rollers 14 for executing a registration operation for synchronizing the timing of sending out the sheet detected by the sensor 13 to the printer engine 2 with an image forming operation in the printer engine 2. Further, an inverting passage 7 is provided on the part of the transfer passage 6 between the first rollers 10 and the second rollers 12, wherein the sheet transferred through the transfer passage 6 is sent to the inverting passage 7.

It is arranged in such a way that the sheet transfer speed on the upstream side to the inverting passage 7, which is determined by the transfer rollers 10, is higher than that on the downstream side, which is determined by the transfer rollers 12. The transfer rollers 10, 12 and the like constitute a sheet transfer device.

On the inverting passage 7, a sheet inverting means 18 is provided. The sheet inverting means 18 has a pair of rollers consisting of a half-moon-shaped driving roller 16, which is driven intermittently by a motor 15 (See FIG. 5) and has a flat-shaped cutout 16*a* formed on part of the outer periphery of the driving roller, and a driven roller 17, which is arranged in a position opposite to the driving roller 16 across the inverting passage 7 and is driven in a following movement upon coming in contact with the part of the driving roller 16 other than the cutout 16*a*. The sheet inverting means 18 makes the sheet sent to the sheet inverting passage 7 switch back, sending out the sheet to the printer engine 2. The constitution of the sheet inverting means 18, as described above, is simpler than the one comprising arms and the like to swing to make or release contact with a sheet. With no arms for nipping a sheet, the sheet inverting means 18 never produces impact noise, making possible for suppressing noises. It will be appreciated that the length of the periphery of the drive roller 16 except the cutout 16*a* is made longer than the distance from the front end of the sheet (illustrated in FIG. 2 as X) just being freed from contact with the driving roller 16 and driven roller 17 of the sheet inverting means 18 to the transfer rollers 12, which is the next transfer means. This makes possible to guide the sheet to the next transfer means, i.e., the transfer means 12, without fail.

Figure 3:
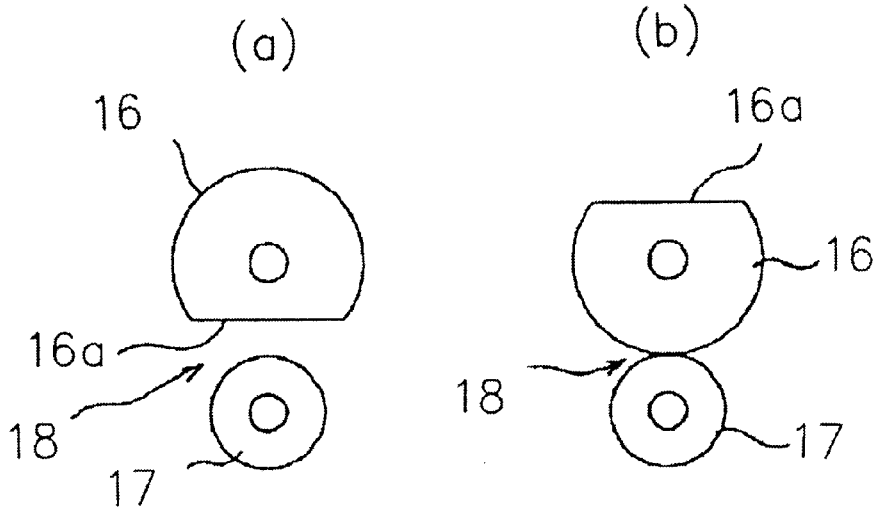
FIG. 3 is an illustrative diagram showing the general view of a sheet inverting means.

FIG. 3 is the illustrative diagram showing the general view of the sheet inverting means 18. As illustrated in FIG. 3(*a*), when the cutout 16*a* of the driving roller 16 faces the driven roller 17, the sheet is allowed to come into the inverting passage 7. When the rear end of the sheet has passed by the transfer rollers 10 as the sheet is sent to the inverting passage 7, the sheet comes to be in "a state of free", where the sheet is nipped by no rollers, then proceeds to a jogger 40, which is to be described later, for correcting a skew of the sheet sent to the inverting passage 7.

As shown in FIG. 3(*b*), when the outer periphery of the driving roller 16 and of the driven roller 17 are abutted each other, rotation of the driving roller 16 makes the driven roller 17 rotate in a following movement, sending out the sheet from the inverting passage 7. The inverting passage 7 is provided with a sheet detecting sensor 19 (See FIG. 5), which detects a sheet for controlling the timing of sending the sheet to or out of the inverting passage 7. As described above, the sheet inverting means 18 can be shifted freely to two states, one of which is a send-out state for making the sheet sent to the inverting passage 7 switch back and sending it out to the sheet transfer passage 6, and the other of which is an open state for allowing at least part of a preceding sheet being sent out from the inverting passage 7 and of a following sheet coming into the inverting passage 7 to overlap. In other words, the preceding sheet being sent out from the inverting sheet 7 and the following sheet coming into the inverting passage 7 are made to pass each other as they are transferred. In this manner, it is made possible to form images sequentially while a minute sheet distance (for example, 10 mm) is set between respective sheets.

Figure 4:
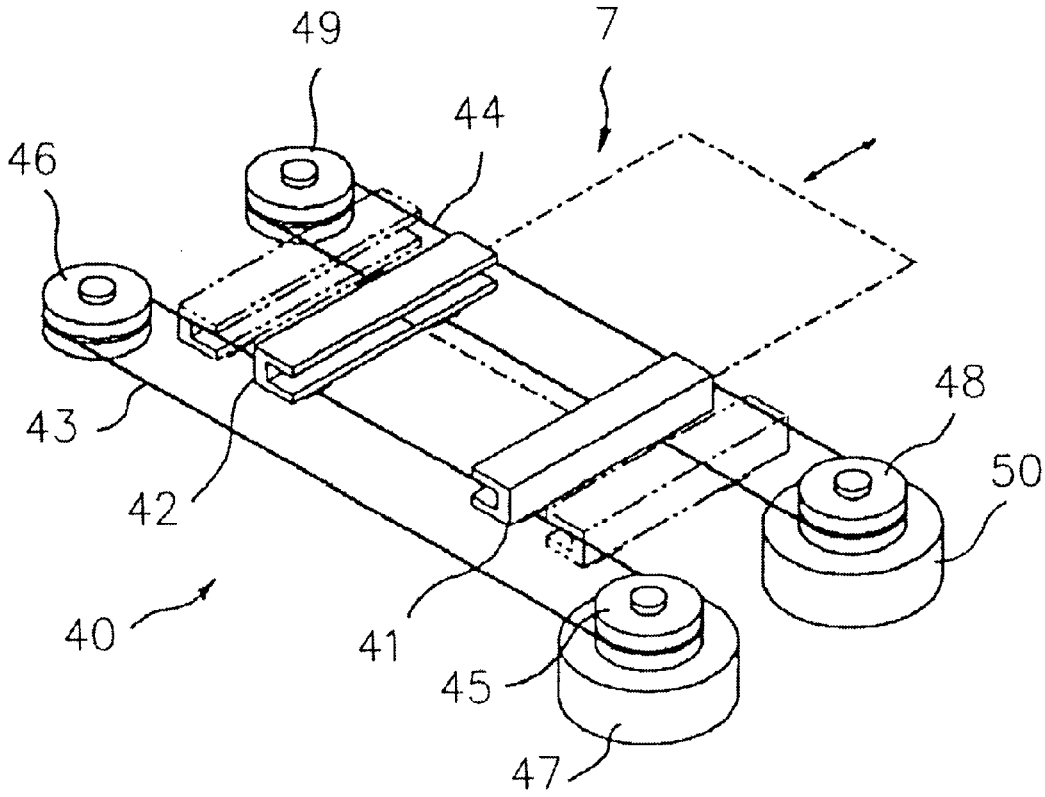
FIG. 4 is an illustrative diagram showing the general view of the constitution of a jogger.

As mentioned before, the jogger 40 is arranged on the inverting passage 7 so as to correct a skew of the sheet sent to the inverting passage 7. The jogger 40 is the movable member for regulating the positioning of the edges of the sheet sent to the inverting passage 7, the edges parallel to the transfer direction. Hereinafter, a detailed description of the jogger 40 is to be made, referring to FIG. 4. As shown in FIG. 4, the jogger 40 has a pair of regulating members 41, 42, each arranged in parallel on both sides of the sheet sent to the inverting passage 7 in the position opposed each other. Each regulating member 41, 42 has a U-shaped section, nipping each edge of the sheet sent to the inverting passage 7, the edge parallel to the transfer direction, from both upper and lower directions, and is arranged so as to independently reciprocate in the direction of contacting with or departing from each edge of the sheet parallel to the transfer direction. More specifically, a wire 43 is rocked on the bottom of the regulating member 41, and a wire 44 is rocked on the bottom of the regulating member 42. The wire 43 is extended between pulleys 45, 46, wherein the pulley 45 is coupled to the drive shaft of a motor 47. The wire 44 is extended between pulleys 48, 49, wherein the pulley 48 is coupled to the drive shaft of a motor 50. According to such an arrangement, the driving force of the motor 47 revolves the pulley 45, 46, making the wire 43 pull the regulating member 41 into motion. Likewise, the driving force of the motor 50 revolves the pulleys 48, 49, making the wire 44 pull the regulating member 42 into motion. Therefore, each regulating member 41 and 42 of the jogger 40 can be independently actuated.

When the pair of regulating members 41, 42 of the jogger 40 are brought close each other, each motor 47 and 50 is revolved counterclockwise, as it is seen in FIG. 4. On the contrary, when the regulating members 41, 42 are distanced from each other, each motor 47 and 50 is revolved clockwise, as it is seen in FIG. 4. In FIG. 4, the jogger 40 illustrated by a virtual line represents that the jogger is moved to an evacuative position in response to the sheet being sent into the inverting passage 7, while the jogger 40 illustrated by a continuous line represents that the jogger is brought close to the sheet which has been sent to the inverting passage 7. When the sheet which has been sent to the inverting passage has a skew, the jogger 40 moved to the position illustrated by the continuous line comes in contact with the sides of the sheet and corrects the skew.

The printer engine 2 comprises respective known equipment for executing image forming processes. The equipment includes a photosensitive body 23 on which an image is formed, an electrifier 24 for charging uniformly the surface of the photosensitive body 23, a digital write-in means for writing in an electrostatic latent image on the photosensitive body 23, a developer 26 for forming a toner image by making toner adhere to the electrostatic latent image on the photosensitive body 23, a laminator 27 for transferring the developed toner image to a sheet, and a cleaning unit 28 for eliminating a residual toner from the photosensitive body 23. Accordingly, images are formed on sheets by a digital electrophotographic process.

A fixing unit 3 has a pressure roller 29 for fixing the toner image transferred to the sheet and a heating roller 30. On the downstream side to the fixing unit 3 in the transfer direction, an ejecting roller 31 is provided for ejecting the sheet with the fixed toner image to an ejecting stacker 4.

Figure 5:
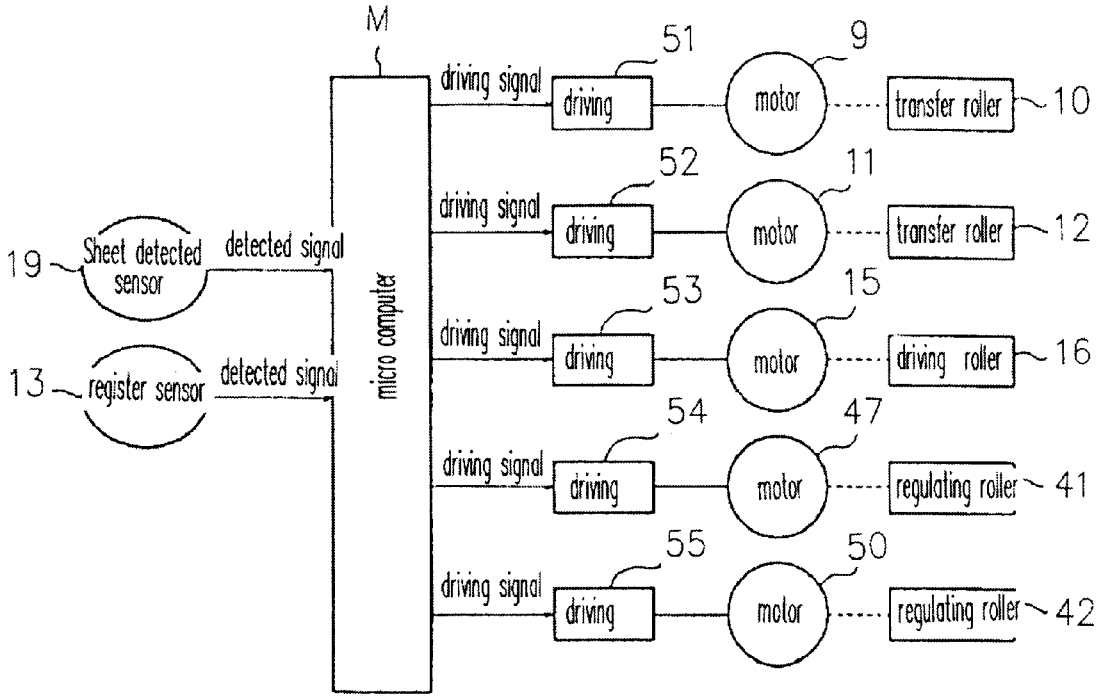
FIG. 5 is a block diagram showing the electrical connection configuration of a control system pertain to sheet transfer in the image forming device.

FIG. 5 is the block diagram showing the electrical connection configuration of the control system pertain to sheet transfer in the image forming device A. As shown in FIG. 5, the control system pertain to sheet transfer is provided with a microcomputer M for controlling collectively respective components constituting the system. A variety of components comprising actuators and sensors are connected to the microcomputer M. The components includes a motor driver 51 for driving the motor 9 rotating the transfer roller 10, a motor driver 52 for driving the motor 11 rotating transfer roller 12, a motor driver 53 for driving the motor 15 rotating the driving roller 16, a motor driver 54 for driving the motor 47 moving the regulating member 41, a motor driver 55 for driving the motor 50 moving the regulating member 42, the sheet detecting sensor 19, and the register sensor 13.

A brief description is to be made concerning the sheet transfer operation executed under the control by the microcomputer M in the above constitution. When the microcomputer M is set to a mode of sequential image forming and a start key (not illustrated) is operated, the feed tray 1*a* starts feeding sheets one after another. The sheet is transferred via sheet transfer passage 6 toward printer engine 2, but is temporarily sent to the inverting passage 7 during the course of transfer, made to switch back by the sheet inverting means 18, and sent out of the inverting passage 7. The sheet sent out of the inverting passage 7 is then transferred through the sheet passage 6 to be sent to the printer engine 2, where an image is formed on the sheet.

As the sheet sent to the inverting passage is made to switch back, the speed of sending the sheet to the inverting passage 7, the speed of sending the sheet out of the inverting passage 7, and the timing of sending the sheet out of the inverting passage 7 are controlled, so that the distance between each sheet, which is sent to the printer engine 2 after made to switch back, can be reduced. As a result, it becomes possible to improve the productivity of the image forming operation.

Next, a skew correcting function is to be described. The function is particular to the image forming device A disclosed in this embodiment, and is performed when the microcomputer M controls each motor 47 and 50 to drive them accordingly, operating the jogger 40.

When it is started to send a sheet to the inverting passage 7, the pair of regulating members 41, 42 of the jogger 40 have been evacuated to the evacuative positions, (the positions making the distance between both the members wider than the width of the incoming sheet), as illustrated by the virtual line in FIG. 4. As the sheet is sent to the inverting passage 7, the rear end of the sheet passes through the transfer rollers 10, bringing the sheet into "a state of free." At this moment, each regulating member moves inward to a position where the distance between both the members is a little narrower than the width of the sheet (preferably, around 1 mm). Therefore, positioning the sheet by the movable member is regulated while the sheet is free from any pressure application, so that the sheet comes to be temporarily free from any regulation, which makes it possible to adjust smoothly the position of the sheet in the direction perpendicular to the proceeding direction. Besides, even if the widths of sheets are uneven (even if it is changed by an environmental factor), the position of the sheet in its width direction can be adjusted without fail. Thus, the skew correction of sheets is carried out during their transfer by moving the sheet to the position where its sides face the jogger and, at the same time, setting the sheet along the pair of parallel regulating members 41, 42.

It will be appreciated that the width of a sheet can be detected if a user input a set sheet size in an appropriate unit or make the unit read the information of a sheet cassette for feeding sheets.

Figure 6:
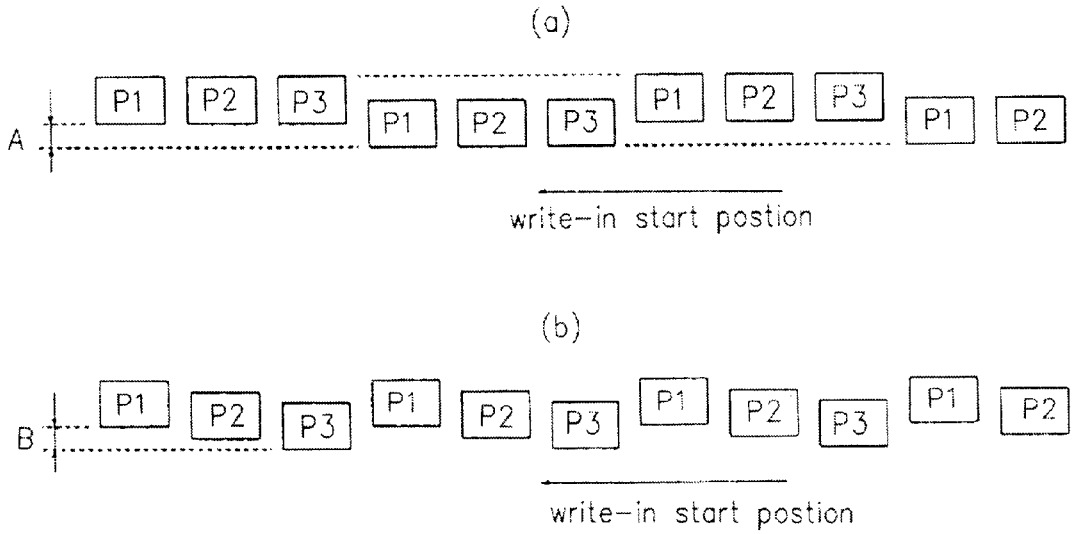
FIG. 6 is an illustrative diagram showing a state of shifting the position of the jogger, wherein (a) illustrates a case where the jogger position is made to shift to the left or right in a distance of A for every three sheets, and (b) illustrates a case where the jogger position is made to shift sequentially or randomly within the maximum width of B.

Now, a detailed description concerning the position of the jogger is to be made. Conventionally, the jogger position has been set so as to keep the center of a sheet in the same position (what is called the center reference), or to keep the edge of a sheet passing the same position (what is called the edge reference). In this embodiment, it is arranged so that the position of the jogger can be randomly changed in the direction of the width of a sheet by making the microcomputer M control each motor 47 and 50 to drive it. The position change of the jogger is made possible, because, as described above, each regulating members 41 and 42 can be independently driven. FIG. 6 shows a state of shifting the position of the jogger. FIG. 6(*a*) illustrates a case where the jogger position is made to shift to the left or right in a distance of A for every three sheets, while FIG. 6(*b*) illustrates a case where the jogger position is made to shift sequentially or randomly within the maximum width of B. In this manner, the regulation position change means is achieved.

By rendering the jogger position changeable in the sheet width direction, concentration of the contact of sheet edges with rollers, such as the transfer rollers 12 or the register rollers 14, in a prescribed position is avoided and earlier replacement of the rollers, such as the fixing rollers, due to their surface exfoliation, can be prevented.

The jogger 40 is controlled to take constantly the same evacuative position, according to detection by an unillustrated positioning sensor. Also, inward movement of the jogger 40 is controlled so that the jogger 40 starts moving at the moment when a prescribed time of "t" has passed after the sheet detecting sensor 19 detected the rear end of a sheet. If the sheet width is changed, the "t" value is changed accordingly. That is, the wider the sheet width becomes, the longer the time of "t" becomes. Thus, it is possible to make the regulating members 41, 42 of the jogger 40 constantly come in contact with the sheet at the moment when a prescribed time has passed after the end of the sheet passed the position of the sheet detecting sensor 19. A longer time of "t" can be described as a deceleration effect of delaying the timing of the inward move of the jogger, which can keep the stopping position of the sheet almost constant.

The skew correcting operation by the regulating members 41, 42 of the jogger 40, as described above, is called "closing state", which is sustained until the sheet is sent out of the inverting passage 7 as the driving roller 16 rotates and the driven roller 17 follows in rotation. As a result, when the positioning regulation by the regulating members 41, 42 of the jogger 40 is released, the sheet has been already under pressure by the transfer rollers 12 on the transfer passage 6, a subsequent position change of the sheet can be prevented.

Thereafter, the driving rollers 16 start rotating (counterclockwise as it is seen in FIG. 2), and each regulating member 41, 42 of the jogger 40 moves outward (in the distance of releasing the contact of the members with the sheet) to the position where the distance between both the members is wider than the sheet width. Then, the sheet is made to switch back by the sheet inverting means 18, and is sent out of the inverting passage 7 to the printer engine 2.

Figure 7:
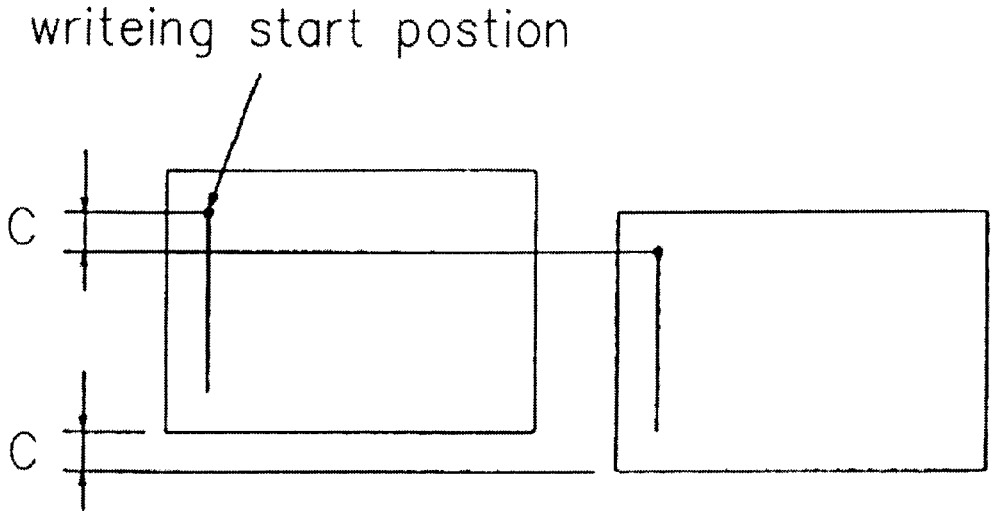
FIG. 7 is an illustrative diagram showing a state of changing the write-in start position on a photosensitive body.

It will be appreciated that, by making the jogger position changeable in the direction of the sheet width, the position in the width direction of a switched back sheet, which is subsequently sent to the printer engine 2, is conformity to the jogger position at the time of the regulation. In response to this, the microcomputer, which is not illustrated, controls the digital write-in means 25 of the printer engine 2, changing the write-in start position on the photosensitive body 23 according to the position of the sheet sent to the printer engine. As shown in FIG. 7, the control is made so as to shift the write-in start position for the digital write-in means 25 by C in response to a relative shift of the sheet position by C. In this manner, the position of an image on sheets can be kept fixed in the same position (providing, write-in images are all the same). Thus, the write-in position change means is achieved.

After an image is formed on the sheet by the digital electrophotographic process in the printer engine 2, the sheet is ejected to the ejecting stacker 4. When the jogger position is shifted to the left and right in a distance of A for every three sheets, as shown in FIG. 6(*a*), the sheets ejected to the ejecting stacker 4 are arranged in a state in which the sheets would be if a sort function or stack function were employed in the ejecting process. It means that, according to the image forming device A disclosed in this embodiment, it becomes possible to "sort" the sheets by shifting the jogger position to the left and right in the distance of A according to the number of printing, as shown in FIG. 6(*a*), whereas a "sort" operation has been carried out conventionally by shaking the whole body of an ejecting unit via a large finisher and the like. Thus, an image forming device can be miniaturized and the sort operation can be carried out with a simple constitution.

Accordingly, the regulating position for positioning a sheet by the jogger 40 is randomly changed, then the write-in start position in the printer engine 2 is shifted in conformity to the changed regulation position, which is the position of the sheet sent to the printer engine 2. Therefore, the regulation position for positioning a sheet by the jogger 40 is made changeable. This makes possible to avoid concentration of the contact of sheet edges with the transfer means, such as rollers, in a prescribed position and to prevent earlier replacement of the rollers, such as the fixing unit 3 in the printer engine 2, due to their surface exfoliation. It is also becomes possible to suppress a temperature increase on the ends of the fixing unit 3 in the printer engine 2.

Figure 8:
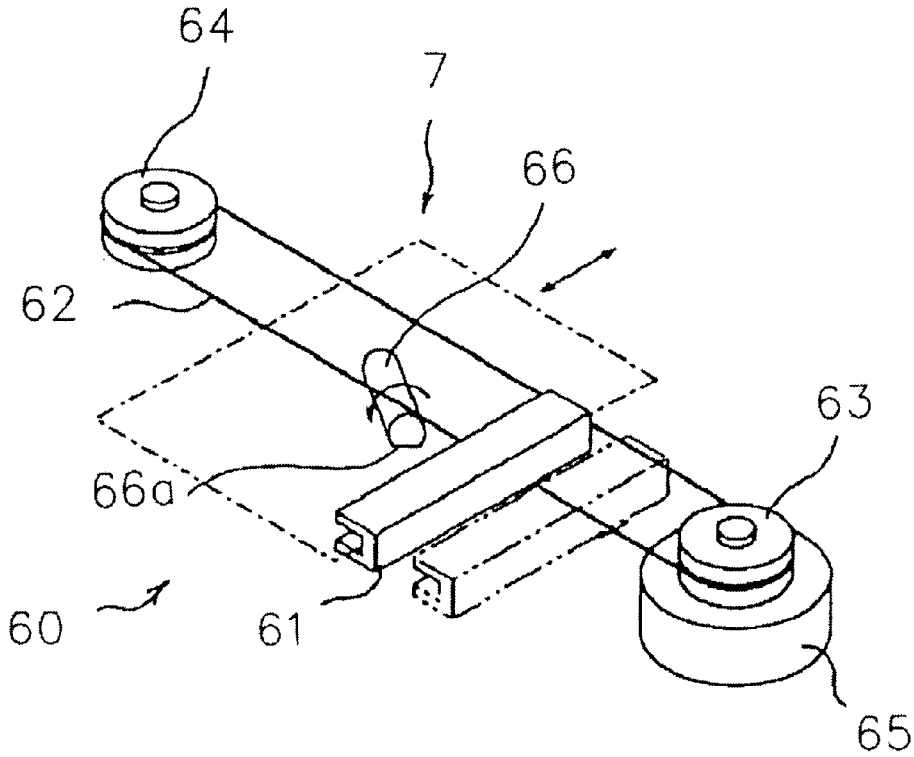
FIG. 8 is an illustrative diagram schematically showing the constitution of a jogger according to the second embodiment of the present invention.

Next, the second embodiment of the present invention is described, referring to FIG. 8. It will be appreciated that the parts same as that of the first embodiment shown in the drawings are represented by the same characters and the description of the parts is omitted. (The same manner will be adopted in the following descriptions of other embodiments.) In the first embodiment, the jogger 40 consisting of the pair of regulation members 41, 42 for regulating "both sides" of a sheet is applied as the movable member for regulating the positioning of the edges of the sheet parallel to the transfer direction in order to correct a skew of the sheet sent to the inverting passage. In the second embodiment, on the other hand, a jogger with a different constitution is applied, wherein a skewing roller is introduced and "only one side" of a sheet is regulated by a side fence and the like.

Hereinafter, an example of a movable member for regulating "only one side" of a sheet is considered in the description referring to FIG. 8. As shown in FIG. 8, a jogger 60, i.e., the above movable member, has a regulating member 61 arranged in the position opposite and parallel to both sides of a sheet sent to the inverting passage. The regulating member 61 has a U-shaped section, nipping the edge of the sheet sent to the inverting passage 7, the edge parallel to the transfer direction, from both upper and lower directions, and is arranged so as to independently reciprocate in the direction of contacting with or departing from the edge of the sheet parallel to the transfer direction. More specifically, a wire 62 is engaged with the bottom of the regulating member 61. The wire 62 is extended between pulleys 63, 64, wherein the pulley 63 is coupled to the drive shaft of a motor 65. According to such an arrangement, the driving force of the motor 65 revolves the pulley 63, 64, making the wire 62 pull the regulating member 61 into motion.

The jogger 60 is further provided with the skewing roller 66. The axial direction of the skew roller is made slightly inclined against the sheet width direction so as to shift the sheet sent to the inverting passage 7 to the regulating member 61.

The skewing roller 66 has a cutout 66*a* formed into a flat surface on part of the outer periphery of the roller. Only when a part other than the cutout part is abutted on a sheet, the sheet sent to the transfer passage 7 is transferred toward the regulation member 61. Therefore, when the sheet is sent to the jogger 60, the cutout 66*a* of the skewing roller 66 is made to face the sheet and the skewing roller is rotated at the moment when the rear end of the sheet has passed through the transfer rollers 10. In this manner, the position of the sheet in the direction of its width can be easily adjusted. It will be appreciated that the constitution described above is simpler than the one for making or releasing contact with the sheet by swinging move of an arm and the like, free from impact noises produced upon catching the sheet, thus, advantageous for suppressing operational noise.

When it is started to send a sheet to the inverting passage 7, the regulating member 61 of the jogger 60 have been evacuated to the evacuative position, (the position where the regulating member does not interfere with the incoming sheet), as illustrated by the virtual line in FIG. 8. As the sheet is sent to the inverting passage 7, the rear end of the sheet passes through the transfer rollers 10, bringing the sheet into "a state of free." At this moment, the microcomputer M drives and controls the motor 65, moving the regulating member 61 inward.

As the one regulating member 61, which is arranged in the position opposite and parallel to the edges of a sheet parallel to the transfer direction, is moved in the direction in which the member contacts with or departs from the sheet edges parallel to the transfer direction, the skewing roller 66 shifts the sheet to the regulating member. This makes possible to shift the position corresponding to the center line of each sheet even if the size of the sheets are the same, so that the position regulation in the direction perpendicular to the proceeding direction can be easily made. Thus, the sheet sent to the inverting passage 7 is further transferred in a state that the sides of the sheet has been set in the position of contact with the regulation member 61, where a skew of the sheet has been corrected.

As described above, the position of the jogger 60 is allowed to be changed randomly in the sheet width direction, as in the case of the aforementioned jogger 40, concentration of the contact of sheet edges with rollers, such as the transfer rollers 12 or the register rollers 14, in a prescribed position is avoided and earlier replacement of the rollers, such as the fixing rollers, due to their surface exfoliation, can be prevented.

Figure 9:
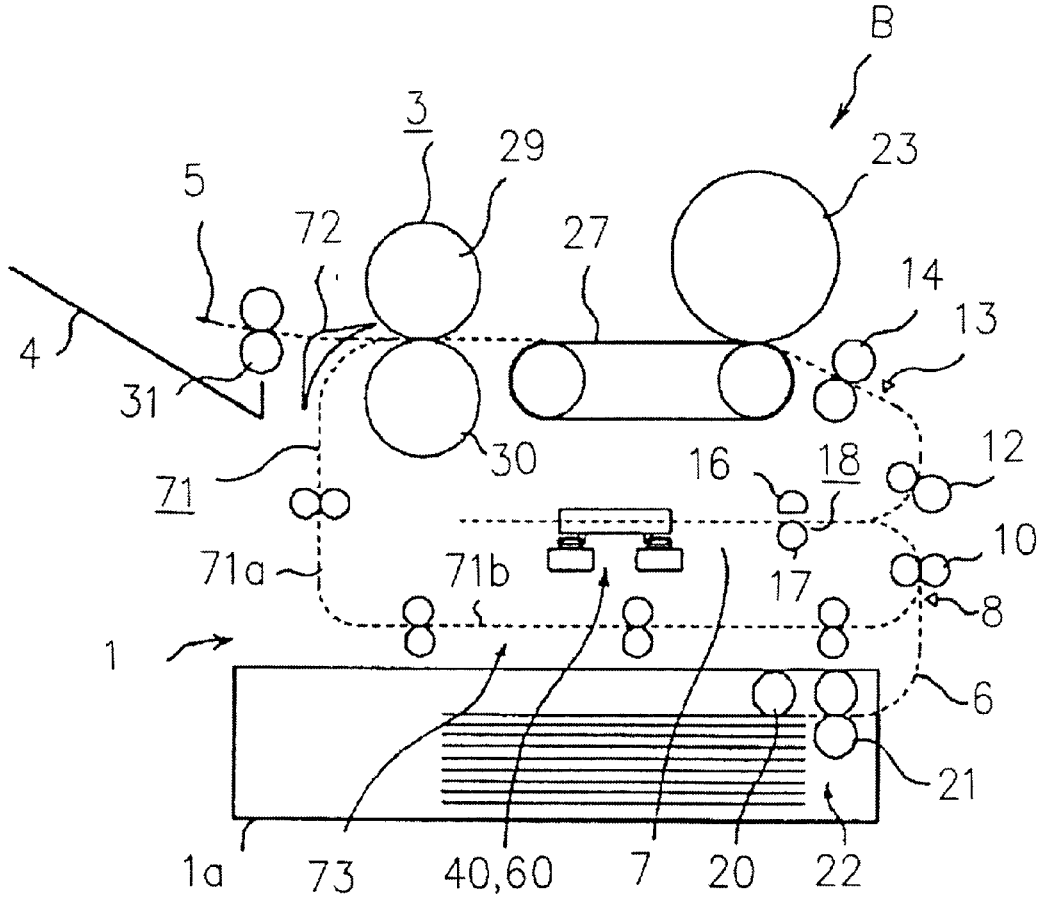
FIG. 9 is a schematic diagram partially showing the constitution of an image forming device having the electrophotographic image forming section according to the third embodiment of the present invention.
Figure 10:
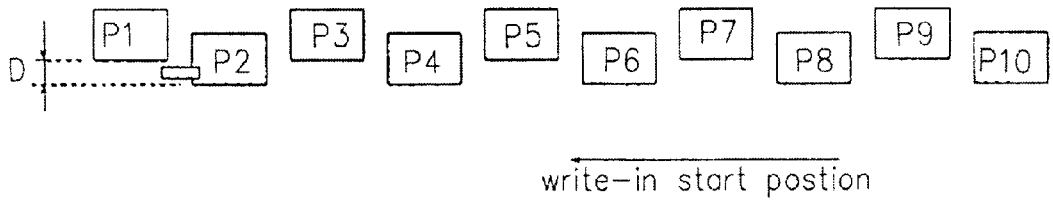
FIG. 10 is an illustrative diagram showing a state of changing the jogger position in conformity to the position of a shift click.

Next, the third embodiment of the present invention is described, referring to FIGS. 9 and 10. In general, an image forming device B disclosed in this embodiment is the image forming device provided with a function enabling double side printing by an interleaf method.

As shown in FIG. 9, the image forming device B further comprises a re-feed passage 71 and a shift click 72 as the path shift member. The shift click 2 is arranged on the upstream side to the ejecting rollers 31 in the transfer direction, shifting the transfer direction of a sheet ejected from the printer engine 2 to a direct course to an ejecting passage 70 or the re-feed passage 71.

The re-feed passage 71 consists of a vertical passage 71*a* extending downward and a horizontal passage 71*b* extending from the lower end of the vertical passage 71*a* in the almost horizontal direction, wherein the front end of the horizontal passage 71*b* is connected to the sheet transfer passage 6. A re-feed means 73 is arranged on the re-feed passage 71, the re-feed means being driven so as to transfer a sheet sent to the re-feed passage 71 toward the sheet transfer passage 6.

The re-feed means 73 is connected to the microcomputer M via various types of motors and actuators, operating under control by the microcomputer M.

When an interleaf feeding is carried under a double side transferring, a sheet with an image formed on its one face (surface) is transferred through the re-feed passage 71, the sheet passage 6, and the inverting passage 7, and is finally sent to the printer engine 2, where an image is formed also on the other face (back). In this manner, both side printing becomes possible. During the above process, a re-feed turnaround and the distance between each sheet can be reduced, the productivity of an image forming operation for double side printing by the interleaf method can be improved.

As described before, by making the jogger position changeable in the direction of the sheet width, the position in the width direction of a switched back sheet, which is subsequently sent to the printer engine 2 where an image is formed on the sheet, is conformity to the jogger position at the time of the regulation. In response to this, the microcomputer M controls the motors 47, 50, shifting the position of jogger according to the position of the shift click 72. More specifically, as shown in FIG. 10, while the jogger position is controlled so that it changes sequentially or randomly up to the maximum width D, the shift click 72 is arranged within the width D. Then, the jogger position for a sheet sent to the re-feed passage 71 is changed beforehand by the width D. As a result, only the sheet sent to the re-feed passage 71 comes to interferes with the shift click 72, proceeding along the click to be further transferred, thus, the transfer path of the sheet is shifted to the re-feed passage 71.

Therefore, an image-fixed sheet can be easily sent directly to the ejecting passage 70 or the re-feed passage 71 without shifting the shift click 72 at a high speed, even in the case of interleaf feeding where the transfer path is shifted during a time span corresponding to a short distance between the sheets (frequent passage shift).

Figure 11:
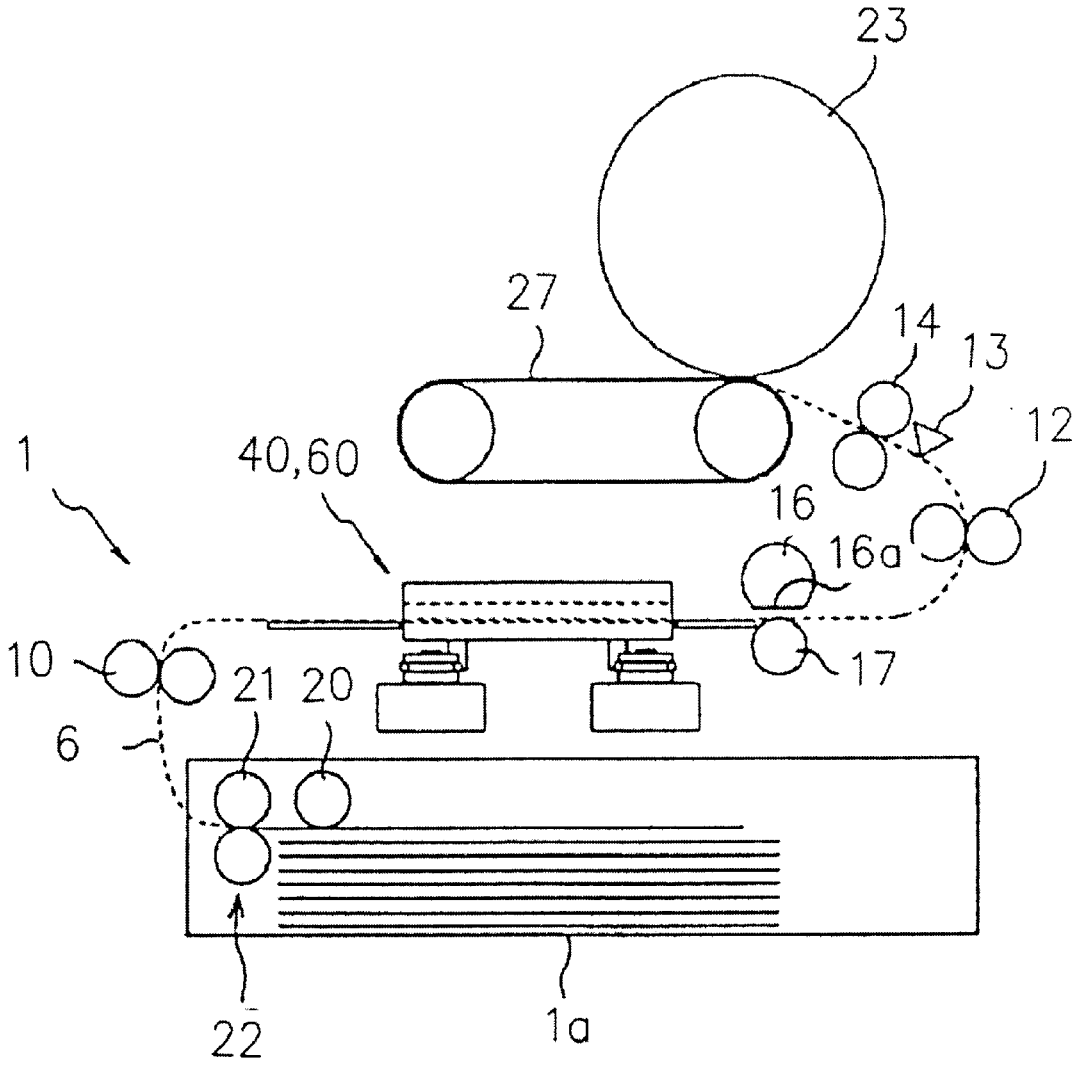
FIG. 11 is a schematic diagram showing an image forming device having the electrophotographic image forming section according to another embodiment of the present invention.

It will be recognized that there are equivalent other ways of achieving the objects of the present invention, whereas it is employed such a constitution in the image forming devices A and B that the inverting passage 7 is provided between the first transfer passage rollers 10 and the second transfer passage rollers 12 on the sheet transfer passage 6. For example, as shown in FIG. 11, it is applicable that the sheet passage leading from the feed tray 1*a* to the register rollers 14 is formed into a S-shape, which includes an almost horizontal plane through which a sheet is transferred in the direction almost horizontal to the surface of the sheets stacked up and held in the feed tray 1*a*, wherein the jogger 40 (the jogger 60) is arranged on the almost horizontal plane. In this constitution, the sheet separately fed one after another by the separate feed tray 1*a* is transferred to the almost horizontal plane, where the position of the sheet is adjusted randomly and the sheet is transferred in the direction almost horizontal to the surface of sheets stacked up and held in the feed tray 1*a*, then is sent to the printer engine 2. Therefore, the sheet position can be adjusted randomly without inverting the transfer direction of the sheet (straight transfer).

Figure 12:
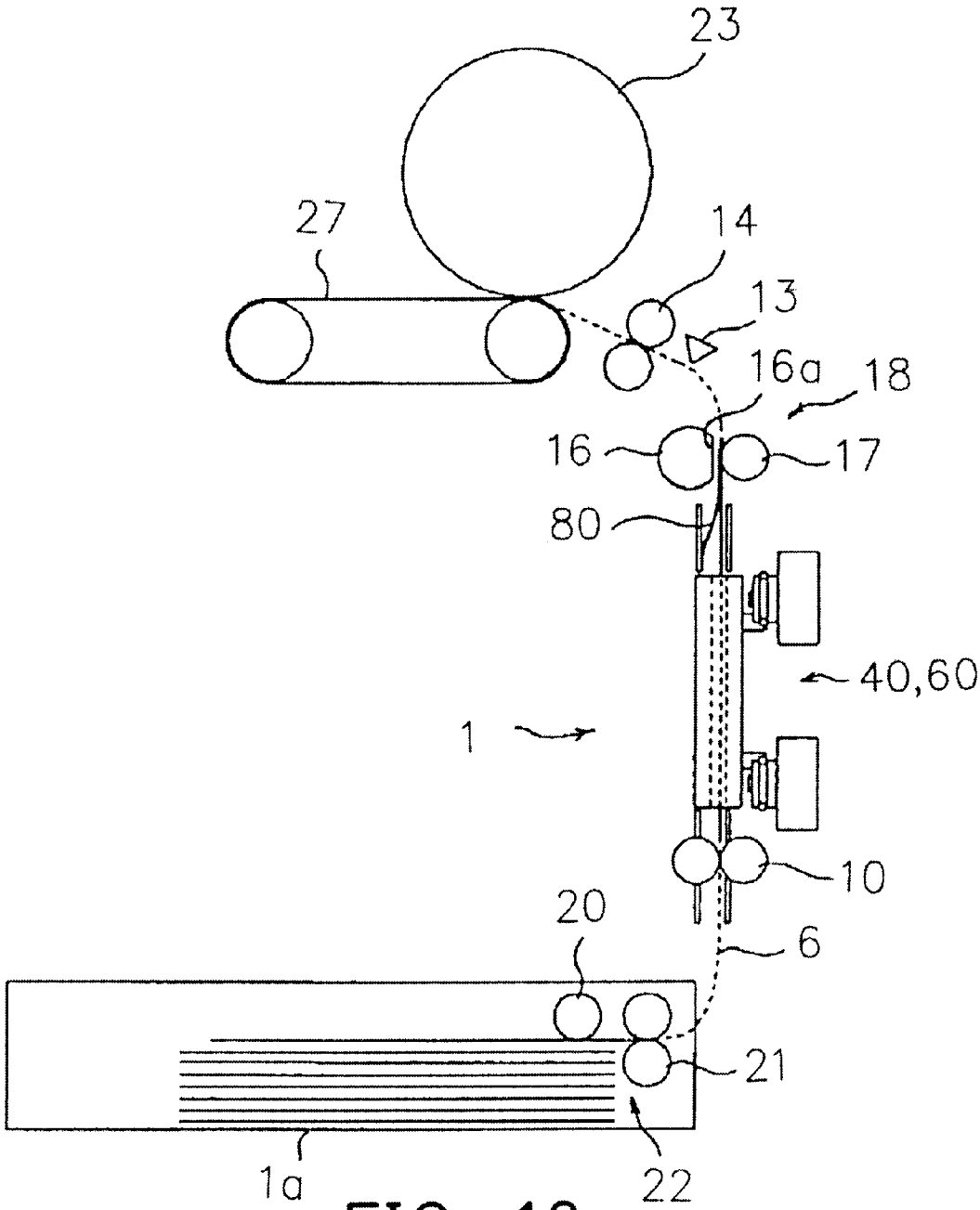
FIG. 12 is a schematic diagram showing an image forming device having the electrophotographic image forming section according to still another embodiment of the present invention.

It is also applicable, as shown in FIG. 12, that the sheet passage leading from the feed tray 1*a* to the register rollers 14 is formed into an almost vertical plane, through which a sheet is transferred in the direction almost vertical to the surface of the sheets stacked up and held in the feed tray 1*a*, wherein the jogger 40 (the jogger 60) is arranged on the almost horizontal plane. In this case, a Mylar 80 is provided on the sheet transfer passage 6 on the downstream side to the jogger 40 (the jogger 60) in the transfer direction, the Mylar 80 being an elastic member for holding the sheet by applying a low load to prevent it from being dropped or moved by its weight. The sheet having passed the transfer rollers 10 comes to be "a free state" without a nip by any rollers and proceeds to come into the jogger 40 (the jogger 60). During the following transfer, the Mylar 80 prevents the sheet from moving by its own weight even when the sheet is released from pressure application by transfer means. In this constitution, the sheet separately fed one after another by the separate feed tray 1*a* is transferred to the almost vertical plane, where the position of the sheet is adjusted randomly and the sheet is transferred in the direction almost vertical to the surface of sheets stacked up and held in the feed tray 1*a*, then is sent to the printer engine 2. Therefore, the sheet position can be adjusted randomly without inverting the transfer direction of the sheet (straight transfer).

According to the invention of claim 1, the image forming device, wherein sheets piled up and held in the sheet housing section is separately fed one after another by the separate feed means and an image is formed on the sheet transferred by the transfer means in the image forming section, comprises the movable member provided on the sheet transfer passage leading from said separate feed means to said image forming section and regulating the positioning of the edges of the sheet parallel to the transfer direction, the sheet being transferred through said sheet transfer passage; the regulating position change means for randomly changing the regulating position for positioning the sheet by said movable means; and the write-in position change means for changing the write-in start position in said image forming device in conformity to the position of the sheet transferred to said image forming section. According to this invention, the regulating position for positioning the sheet by the movable member is randomly changed, and the write-in start position in the image forming section is also changed conforming to the changed regulating position for positioning the sheet, i.e., the position of the sheet which is to be transferred to the image forming section. As described above, the regulating position for positioning the sheet by the movable member is made changeable, so that concentration of the contact of sheet edges with the transfer means, such as rollers, in a prescribed position is avoided and earlier replacement of the rollers, such as the fixing rollers in the image forming section, due to their surface exfoliation, can be prevented. Furthermore, a temperature increase of the ends of the fixing rollers in the image forming section can also be suppressed.

According to an aspect of the present invention, in the image forming device, the regulation of positioning a sheet by said movable member is executed while the sheet on said sheet transfer passage is free from pressure application by any members. Since positioning the sheet by the movable member can be regulated while the sheet is free from any pressure application, the sheet comes to be temporarily free from any regulation of its position, which makes it possible to adjust smoothly the position of the sheet in the direction perpendicular to the proceeding direction.

In an aspect of the present invention, in the image forming device of the present invention, the movable member has the pair of regulating members, which are arranged in parallel in the positions opposite to respective edges of a sheet parallel to the transfer direction, and said regulating position change means moves said each regulating member asymmetrically. In this invention, therefore, the position of the center line of each sheet can be shifted even if the size of the sheets are the same, so that the position regulation in the direction perpendicular to the proceeding direction can be easily made.

According to an aspect of the present invention, in the image forming device, each regulating member is arranged in such a way that each can reciprocate independently in the direction of its contacting with or departing from the edge of a sheet parallel to the transfer direction. In this invention, therefore, it becomes possible in a simple constitution that the pair of regulating members each arranged in parallel in the positions opposite to respective sides of the sheet can be moved asymmetrically.

According to an aspect of the present invention, in the image forming device, each regulating member is moved to the position where the distance between each regulating member becomes narrower than the width of a sheet. In this invention, therefore, even if the widths of the sheets are uneven (even if it is changed by an environmental factor), the position of the sheet in its width direction can be adjusted without fail.

According to an aspect of the present invention, in the image forming device, the movable member has one regulating member, which is arranged in the position opposite and parallel to the edges of a sheet parallel to the transfer direction, and the skewing roller arranged in a state that its axis is inclined against the sheet axis direction, wherein said regulation position change means moves said regulating member in the direction of its contacting with or departing from the sheet edge parallel to the transfer direction. In this invention, therefore, it becomes possible to shift the position corresponding to the center line of each sheet even if the size of the sheets are the same, so that the position regulation in the direction perpendicular to the proceeding direction can be easily made.

According to an aspect of the present invention, in the image forming device, the skewing roller has a cutout formed into a flat surface on part of the outer periphery of the roller. Only when a part other than the cutout part is abutted on a sheet, the sheet sent to the transfer passage is transferred toward the regulation member. In this invention, therefore, when the sheet is sent to the movable member, the cutout of the skewing roller is made to face the sheet and the skewing roller is rotated at the moment when the rear end of the sheet has passed through the transfer means. In this manner, the position of the sheet in the direction of its width can be easily adjusted. It will be appreciated that the constitution described above is simpler than the one for making or releasing contact with the sheet by swinging movement of an arm and the like, free from impact noises produced upon catching the sheet, thus, advantageous for suppressing operational noise.

According to an aspect of the present invention, in the image forming device, the regulation of positioning a sheet by said regulating means is sustained until the sheet is sent out of said sheet transfer passage. In this invention, therefore, when the sheet becomes free from the regulation by the regulating member, the sheet has already received pressure from the transfer means of the sheet transfer passage, so that the position change of the sheet in the following course of transfer can be prevented.

According to an aspect of the present invention, in the image forming device, the regulating position change means changes the regulating position for positioning a sheet by said movable member so that the regulating position is shifted to the left and right in a prescribed distance per a prescribed number of printing. In this invention, therefore, it becomes possible to "sort" the sheets by shifting the regulating position for positioning a sheet by said movable member to the left and right in a prescribed distance according to the number of printing, whereas a "sort" operation has been carried out conventionally by shaking the whole body of an ejecting unit via a large finisher. Thus, an image forming device can be miniaturized and a sort operation can be carried out with a simple constitution.

According to an aspect of the present invention, in the image forming device, the regulating position change means changes sequentially or randomly the regulating position for positioning a sheet by said movable member by a prescribed width. In this invention, therefore, concentration of the contact of sheet edges with the transfer means, such as rollers, in a prescribed position is avoided and earlier replacement of the rollers, such as the fixing rollers in the image forming section, due to their surface exfoliation, can be prevented without fail.

According to an aspect of the present invention, the image forming device of claim 10 comprises the re-feed passage connected between the sheet ejecting side of said image forming section and said sheet passage; and the path shift member, which is arranged in a position where it interferes with only one regulating position for positioning a sheet by said movable member, the position of arrangement being on the sheet ejecting side of said image forming section, and shifts the transfer direction of the sheet, on which an image is formed in said image forming section after the regulating position of said movable member has been changed, to said re-feed passage. In this invention, therefore, the regulating position for the sheet is changed by the movable member so that only the sheet which is to be transferred to the re-feed passage interferes with the path shift member. As a result, the transfer direction of the sheet with an image formed thereon in the image forming section can be easily shifted to the re-feed passage without shifting the position of the path sift member at a high speed, even in the case of interleaf feeding where the path shift is made during a time span corresponding to a short distance between the sheets (frequent passage shift).

According to an aspect of the invention, the image forming device of claim 1 or 11 further comprises the inverting passage, which is connected to the middle of the sheet transfer passage leading from said separate feed means to said image forming section and to which a sheet transferred through the sheet transfer passage is temporarily sent; and the sheet inverting means, which can be shifted to a send-out state for making the sheet sent to said inverting passage switch back and sending it out to said transfer passage and shifted to an open state for allowing at least part of a proceeding sheet being sent out of said inverting passage and of a following sheet being sent to said inverting passage to overlap; wherein said movable member is provided on said inverting passage. In this invention, therefore, it is possible to make the movable member to constantly carry out the regulation of positioning the sheet in a stable position.

In the image forming device of the present invention, the sheet inverting means has the pair of rollers, one of which has a cutout formed on part of its outer periphery, wherein the direction of the cutout enables the shift between said send-out state for making the rollers nip a sheet and said open state for allowing the sheet to passes between both rollers. The above constitution provided by this invention is simpler than the one makes or releases contact with the sheet by swinging move of an arm and the like, free from impact noises produced upon catching the sheet, thus, operational noise can be suppressed.

In the image forming device of claim 13, according to the invention of claim 14, the outer periphery length, excepting the part of cutout, of one roller is made longer than the distance from the front end of a sheet in a state of just being released from the contact with said rollers to the next said transfer means on said transfer passage. In this invention, therefore, such an arrangement enables the sure transfer of the sheet to the next transfer means.

In the image forming device of the present invention, the sheet transfer passage leading from said separate feed means to said image forming section has the almost horizontal plane, via which a sheet is transferred in the direction almost horizontal to the surface of sheets stacked up and held in the sheet housing section and which is provided with said movable member. Accordingly, the sheet separately fed one after another by the separate feed means is transferred to the almost horizontal plane, where the position of the sheet is adjusted randomly and the sheet is transferred in the direction almost horizontal to the surface of sheets stacked up and held in the sheet housing section, and is sent to the image forming section. In this invention, therefore, the sheet position can be adjusted randomly without inverting the transfer direction of the sheet (straight transfer).

In the image forming device of claim of the present invention, the sheet transfer passage leading from said separate feed means to said image forming section has the almost vertical plane, via which a sheet is transferred in the direction almost vertical to the surface of sheets stacked up and held in the sheet housing section and which is provided with said movable member. The elastic member is provided on said sheet transfer passage on the downstream side to said movable member in the transfer direction in order to hold the sheet by applying a low load to prevent it from falling off or moving because of its weight. The sheet separately fed one after another by the separate feed means is transferred to the almost vertical plane, where the position of the sheet can be adjusted randomly and the sheet is transferred in the direction almost vertical to the surface of sheets stacked up and held in the sheet housing section, and then is sent to the image forming section, wherein the elastic member can prevent the sheet from moving because of its won weight even when the sheet is released from pressure application by the transfer means during transfer. In this invention, therefore, the sheet position can be adjusted randomly without inverting the transfer direction of the sheet (straight transfer).

In the image forming device of the present invention, the image forming section is an image forming section employing an electrophotographic method. The image forming device of this invention, which forms images by the electrophotographic method, can provide an operational effect equivalent to that achieved by the invention of claim 1 or 15.

In the image forming device of the present invention of claim 18, said image forming section is the electrophotograhic image forming section having the digital write-in means. The image forming device of this invention, which forms images by the digital electrophotographic method, can provide an operational effect equivalent to that described above.

According to the present invention, the feed device separately feeds a sheet one after another by the separate feed means, said sheets stacked up and held in a sheet housing section, for the image forming device provided with the image forming section for forming an image on the sheet. The feed device comprises the movable member provided on the sheet transfer passage leading from said separate feed means to said image forming section and regulating the positioning of the edges of the sheet parallel to the transfer direction, the sheet being transferred through said sheet transfer passage; and the regulating position change means for randomly changing the regulating position for positioning the sheet by said movable means; wherein the regulating position for positioning the sheet by the movable member can be changed randomly. In this invention, therefore, the regulation position for positioning the sheet is made changeable, as mentioned above, so that concentration of the contact of sheet edges with transfer means, such as rollers, in a prescribed position is avoided and earlier replacement of the rollers, such as the fixing rollers in the image forming section, due to their surface exfoliation, can be prevented.

According to the image forming device of the present invention, wherein sheets piled up and held in the sheet housing section is separately fed one after another by the separate feed means and an image is formed on the sheet transferred by the transfer means in the image forming section, the image forming device comprises the movable member provided on the sheet transfer passage leading from said separate feed means to said image forming section and regulating the positioning of the edges of the sheet parallel to the transfer direction, the sheet being transferred through said sheet transfer passage; the regulating position change means for randomly changing the regulating position for positioning the sheet by said movable means; and the write-in position change means for changing a write-in start position in said image forming device in conformity to the position of the sheet transferred to said image forming section, wherein the regulating position for positioning the sheet by the movable member is randomly changed in the direction of a sheet width, and the write-in start position in the image forming section is also changed conforming to the changed regulating position for positioning the sheet, i.e., the position of the sheet which is to be transferred to the image forming section. In this invention, therefore, the regulating position for positioning the sheet by the movable member is made changeable in the sheet width direction, so that concentration of the contact of sheet edges with transfer means, such as rollers, in a prescribed position is avoided and earlier replacement of the rollers, such as the fixing rollers in the image forming section, due to their surface exfoliation, can be prevented. Furthermore, a temperature increase of the ends of the fixing rollers in the image forming section can also be suppressed.

In the image forming device of the present invention, the movable member has the pair of regulating members each arranged in the position opposite to respective sides of a sheet, wherein said regulating position change means moves said each regulating member asymmetrically. In this invention, with the asymmetrical moves by the above members, the position of the center line of each sheet can be shifted even if the size of the sheets are the same, so that the position regulation in the direction perpendicular to the proceeding direction can be easily made.

While the present invention has been described with a preferred embodiment, the description is not intended to limit our invention. Various modifications of the embodiment will be apparent to those skilled in the art. It is therefore contemplated that the appended claims will cover any such modifications or embodiments as fall within the true scope of the invention.

What is claimed is:

1. An image forming device, wherein sheets piled up and held in a sheet housing section are separately fed one after another by a separate feed means and an image are formed on a sheet transferred by a transfer means in an image forming section, comprising:

a movable member provided on a sheet transfer passage leading from said separate feed means to said image forming section and regulating a positioning of edges of the sheet parallel to the transfer direction, the sheet being transferred through said sheet transfer passage;

a regulating position change means for randomly changing a regulating position for positioning the sheet by said movable member; and a write-in position change means for changing a write-in start position in said image forming device in conformity to the position of the sheet transferred to said image forming section.

2. The image forming device of claim 1, wherein the regulation of positioning a sheet by said movable member is executed while the sheet on said sheet transfer passage is free from pressure application by any members.

3. The image forming device of claim 1, wherein said movable member has a pair of regulating members, which are arranged in parallel in the positions opposite to respective edges of a sheet parallel to the transfer direction, and said regulating position change means moves each one of the pair of regulating members asymmetrically.

4. The image forming device of claim 3, wherein said each one of the pair of regulating members is arranged in such a way that each can reciprocate independently in the direction of its contacting with or departing from the edge of a sheet parallel to the transfer direction.

5. The image forming device of claim 1, wherein said each one of the pair of regulating members is moved to the position where the distance between each regulating member becomes narrower than a width of a sheet.

6. The image forming device of claim 1, wherein said movable member has one regulating member, which is arranged in a position opposite and parallel to the edges of a sheet parallel to the transfer direction; and a skewing roller arranged in a state that its axis is inclined against a direction of sheet width; and said regulation position change means moves said regulating member in a direction of its contacting with or departing from the sheet edges parallel to the transfer direction.

7. The image forming device of claim 6, wherein said skewing roller has a cutout formed into a flat surface on part of an outer periphery of the skewing roller, and a sheet sent to a transfer passage is transferred toward a regulation member only when a part other than the cutout part is abutted on the sheet.

8. The image forming device of claim 3, wherein the regulation of positioning a sheet by said regulating members is sustained until the sheet is sent out of said sheet transfer passage.

9. The image forming device of claim 1, wherein said regulating position change means changes a regulating position for positioning a sheet by said movable member so that a regulating position is shifted to a left and right in a prescribed distance for a prescribed number of printings.

10. The image forming device of claim 1, wherein said regulating position change means changes sequentially or randomly a regulating position for positioning a sheet by said movable member by a prescribed width.

11. The image forming device of claim 10, comprising:

a re-feed passage connected between the sheet ejecting side of said image forming section and said sheet transfer passage; and a path shift member, which is arranged in a position where it interferes with only one regulating position for positioning a sheet by said movable member, the position of arrangement being on the sheet eject side of said image forming section, and which shifts the transfer direction of the sheet, on which an image is formed in said image forming section after the regulating position of said movable member has been changed, to said re-feed passage.

12. The image forming device of claim 1 further comprising:

an inverting passage, which is connected to the sheet transfer passage leading from said separate feed means to said image forming section and to which a sheet transferred through the sheet transfer passage is temporarily sent; and a sheet inverting means, which can be shifted to a send-out state for making the sheet sent to said inverting passage switch back and sending it out to said transfer passage, and shifted to an open state for allowing at least part of a proceeding sheet being sent out of said inverting passage and of a following sheet being sent to said inverting passage to overlap, wherein said movable member is provided on said inverting passage.

13. The image forming device of claim 12, wherein said sheet inverting means has a pair of rollers, one of which has a cutout formed on part of its outer periphery, and the direction of the cutout enables the shift between said send-out state for making the rollers nip a sheet and said open state for allowing the sheet to pass between both rollers.

14. The image forming device of claim 13, wherein the outer periphery length, excepting a part of cutout, of one roller is made longer than the distance from the front end of a sheet in a state of just being released from contact with said rollers to the next said transfer means on said sheet transfer passage.

15. The image forming device of claim 1, wherein the sheet transfer passage leading from said separate feed means to said image forming section has an almost horizontal plane, via which a sheet is transferred in the direction almost horizontal to the surface of sheets stacked up and held in a sheet housing section and which is provided with said movable member.

16. The image forming device of claim 1, wherein the sheet transfer passage leading from said separate feed means to said image forming section has an almost vertical plane, via which a sheet is transferred in the direction almost vertical to the surface of sheets stacked up and held in a sheet housing section and which is provided with said movable member, and an elastic member is provided on said sheet transfer passage on the downstream side to said movable member in the transfer direction in order to hold the sheet by applying a low load to prevent it from falling off or moving because of its weight.

17. The image forming device of claim 1, wherein said image forming section is an image forming section employing an electrophotographic method.

18. The image forming device of claim 1, wherein said image forming section is an electrophotographic image forming section provided with a digital write-in means.

19. A feed device separately feeding a sheet one after another by a separate feed means, said sheets stacked up and held in a sheet housing section, for an image forming device having an image forming section forming an image on the sheet, comprising:

a movable member provided on a sheet transfer passage leading from said separate feed means to said image forming section and regulating a positioning of edges of the sheet parallel to a transfer direction, the sheet being transferred through said sheet transfer passage; and a regulating position change means for randomly changing a regulating position for positioning the sheet by said movable member.

20. The image forming device of claim 19, wherein sheets piled up and held in a sheet housing section are separately fed one after another by a separate feed means and an image is formed on the sheet transferred by a transfer means in an image forming section, comprising:

a movable member provided on a sheet transfer passage leading from said separate feed means to said image forming section and regulating the positioning of the edges of the sheet parallel to the transfer direction, the sheet being transferred through said sheet transfer passage;

a regulating position change means for randomly changing a regulating position for positioning the sheet by said movable member; and a write-in position change means for changing a write-in start position in said image forming device in conformity to the position of the sheet transferred to said image forming section.

21. The image forming device of claim 20, wherein said movable member has a pair of regulating members each arranged in the position opposite to respective sides of a sheet, and said regulating position change means moves said each regulating member asymmetrically.

* * * * *